United States Patent [19]

Stange et al.

[11] 4,094,749

[45] June 13, 1978

[54] SURFACE TREATMENT WITH DURABLE LOW-FRICTION MATERIAL

[75] Inventors: Ronald R. Stange, Denver; Samuel B. McGuire, Arvada; Thomas W. Woodring, Westminster, all of Colo.

[73] Assignee: Tools for Bending, Inc., Denver, Colo.

[21] Appl. No.: 702,333

[22] Filed: Jul. 6, 1976

[51] Int. Cl.[2] ..... C25D 5/00; C25D 5/48

[52] U.S. Cl. ..... 204/25; 204/34; 204/35 R; 204/37 R; 204/38 E; 428/613; 428/626; 428/681

[58] Field of Search ..... 204/25, 34, 35 R, 37 R, 204/38 E; 427/383, 409; 29/180 NM, 195 P, 196.6; 428/613, 626, 681

[56] References Cited

U.S. PATENT DOCUMENTS

| | | | |
|---|---|---|---|
| 2,430,750 | 11/1947 | Webersinn et al. | 204/35 |
| 2,450,296 | 9/1948 | Passalacqua | 204/37 R |
| 3,279,936 | 10/1966 | Forestek | 204/38 E X |
| 3,591,468 | 7/1971 | Nishio et al. | 204/35 R |

*Primary Examiner*—G. L. Kaplan
*Assistant Examiner*—William T. Leader
*Attorney, Agent, or Firm*—John E. Reilly

[57] ABSTRACT

The present invention pertains to the treatment of a metal surface with a durable low-friction material in such a way as to greatly enhance the lubricant properties of the metal surfaces. The surface coating formed is a chromium plated surface containing microcracks so prepared as to permit injection or insertion of perfluorocarbon compositions such as polytetrafluoroethylene in a fused or nearly-fused state. In the method of forming the surface coating as described, the surface is plated by electrodeposition in a chromic acid bath followed by baking to oxidize the external plated surface. In this way, the surface may then be reverse etched to expand the microcracks without affecting the external surface, following which the plated surface may be heated to, or in excess of, the fusion point of the polytetrafluoroethylene material which is inserted preferably by application to the surface from a solid rod.

11 Claims, 3 Drawing Figures

SURFACE TREATMENT WITH DURABLE LOW-FRICTION MATERIAL

This invention relates to the surface treatment of porous metal surfaces and more particularly relates to formation of surface coatings in which a low coefficient-of-friction material is injected into cracks or fissures formed in the surface at or near its fusion point.

BACKGROUND OF THE INVENTION

The art of porous chromium plating has been in widespread use for a number of years both in decorative plating and industrial or so-called "hard chromium" plating. As evolved over the years, three principal control factors are employed in hard chromium plating: (1) the manner of deposition of the chromium plate onto the metal surface; (2) the etching treatment; and (3) the finishing of the resultant plated surface. Conventionally, the plating operation requires close control of the composition of the bath, its temperature and current density. The etching step may be done by any of several methods including chemical or electrochemical treatments and the etched effect may also be produced by mechanical means. Several types of finishing are customarily employed such as polishing, lapping or honing, and it is generally considered that the amount of plating removed and its rate of removal affects the porosity of the plate.

Typically, porous chromium plate in which the plating is formed with fissures, pits or microcracks has been used in articles in which wear and operating characteristics are at a premium, such as, in the production of piston rings and cylinder walls, since the porous chromium plate is known to act as an extremely good bearing surface having improved load-carrying and lubricating characteristics. As the chromium is deposited in the plating operation, cracks of microscopic size are produced almost in a random pattern resulting from the stresses created in the deposit. As the stress develops until it reaches the ultimate strength of the chromium deposit, the resultant fracture relieves the stress thereby leaving fine cracks in the plating. The size and type of the porosity, or microcracking, can be controlled by various means and for example an etching step following the initial plating step is known to widen or expand the cracks formed. Generally, as the etching proceeds, the fissures or cracks initially deepen and widen; however, eventually an equilibrium is established between the rate of dissolving in the cracks or fissures and from the surfaces so that there is relatively little, if any, further increase in the depth of the fissures or pores. Beyond this point, the plate continues to dissolve without any apparent increase in the depth of channels unless some preliminary treatment is employed to protect the surface against erosion or eating away during the etching process. Thus one object of the present invention is to provide a means of controlled microcracking and specifically of selective expansion of the microcracks by etching without in any way altering or affecting the external surface of the plate.

Moreover, in microcracking a hard chromium plate, factors favoring a desirable crack pattern include relatively high bath temperatures, low chromic acid concentration, relatively high fluoride content and thickness. A conventional approach in chromium plating has been the formation of the plate in multiple layers by application of two successive baths, the first to obtain coverage and thickness and the second to create the desired pattern of cracks. However, it has been found in accordance with the present invention that the initial crack pattern may be formed in a single chromium plating operation followed by heat treatment as a preliminary to reverse etching to expand the crack pattern, and in this relation, it is desirable to carry out the plating operation for a sufficient length of time to insure a relatively thick plating for example in the range of 0.002 to 0.004 inches in thickness.

In recent years it has been found that the lubricant or low-friction characteristics of hard chromium plated surfaces can be greatly enhanced by the injection or insertion of perfluorocarbon resins such as polytetrafluoroethylene into the fissures or pores formed in the plated surface. For example, U.S. Pat. No. 3,279,936 to Forestek is representative of such a process specifically wherein a porous surface such as a microcracked chromium plated surface has applied thereto non-fused particles of polytetrafluoroethylene which are mechanically locked into the fissures or cracks formed in the surface. Generally, in accordance with the Forestek patent, the approach taken is to heat the plated surface above a predetermined temperature level to enlarge the fissures by thermal explosion and to mechanically force unfused particles into the pores. It is theorized that when the surface is then cooled, the size of the pores or fissures is reduced to mechanically lock the particles in place by an interference fit. However, such process presupposes that the powdered resin is locked physically in place within the pores or fissures, and therefore specific limits are placed on the temperatures to which the surface may be heated in order to avoid fusion of the polytetrafluoroethylene particles, specifying that the maximum temperature limit be 650° F and preferably less than 500° F in the range of 250° to 400° F. In practice, however, it has been found that the degree of expansion induced merely by heating to a limited extent is indeed very slight making it difficult to assure uniform and complete filling of the fissures or pores with unfused particles. Moreover, the degree of contraction of the fissures once cooled is not such as to uniformly lock the particles in place particularly when the surface is subjected to heat expansion or repeated wear over an extended period of time.

SUMMARY OF THE INVENTION

It is therefore an object of the present invention to provide for a novel and improved method for application of perfluorocarbon compositions to a porous metal surface in such a way as to greatly improve and enhance its lubricant and wear characteristics.

It is another object of the present invention to provide for a novel and improved hard chromium plating process and specifically a process in which a well-defined microcrack pattern of predetermined width and depth can be formed in the surface of the chromium plating.

A further object of the present invention is to provide for an article of manufacture in which a microcracked or porous metal surface contains fused durable low-friction materials therein to greatly enhance its lubricant and wear characteristics.

It is an additional object of the present invention to provide for microcracked chromium plated surfaces containing fused polytetrafluoroethylene material in the fissures formed in the plated surface as well as a novel and improved method of aplication of the polytetrafluoroethylene to the surface so as to assure uniform filling of the cracks or pores in the surface.

Initial preparation of the basic metal surface as followed and practiced under the present invention essentially involves conventional considerations of metallurgy, cleaning and activation. The most desirable metal surface for use in hard chromium plating is a smooth, homogenous metal of the desired tensile strength which is prepared to have a smear-free surface in order to develop the desired adhesion. Cleaning to remove objectionable films on the metal surface, such as grease, oil or foreign matter, can be carried out by well-known mechanical or electrolytic scrubbing operations. Activation is sometimes necessary to remove films which remain on the surface in the form of scale or metallic compounds and in some cases require pickling in acid solution either anodically or cathodically to remove the scale, often referred to as oxide films.

In accordance with the present invention, a method of chromium plating a metal surface has been devised in which the metal surface is plated in a chromium acid bath in such a way as to form a well-defined microcrack pattern therein. Following the plating step, the plated surface is heated to oxidize the surface so that when subsequently etched to expand the fissures or cracks formed in the plating step the external surface will not be altered or affected in any way. Thereafter, the surface may be heated to a temperature level at or in excess of the fusion point of a low-friction perfluorocarbon composition which is then directly applied to the surface and fused into the microcracks formed.

In its preferred form, the method of the present invention is employed in the surface coating of tube bending mandrels or other metal cold-forming tools and more specifically comprises the steps of hard chromium plating the surface to a thickness on the order of 0.002 to 0.004 inches followed by baking at a temperature in the range of 250° to 600° F for a period on the order of one to five hours after plating. These have been found to provide the optimum conditions for oxidation of the plating surface as a preliminary to reverse etching and resultant expansion of the microcrack pattern. Reverse etching is suitably carried out by applying a reverse polarity to the chromic acid bath. Thereafter, a polytetrafluoroethylene material is applied to the surface at an elevated temperature sufficient to fuse the polytetrafluoroethylene into the cracks or fissures, the temperature ranging from 600° F to in excess of 900° F.

The foregoing and other objects, features and advantages of the present invention will be more readily apparent in view of the following detailed description of the preferred embodiment.

DETAILED DESCRIPTION OF THE PREFERRED EMBODIMENT

Figure 1:
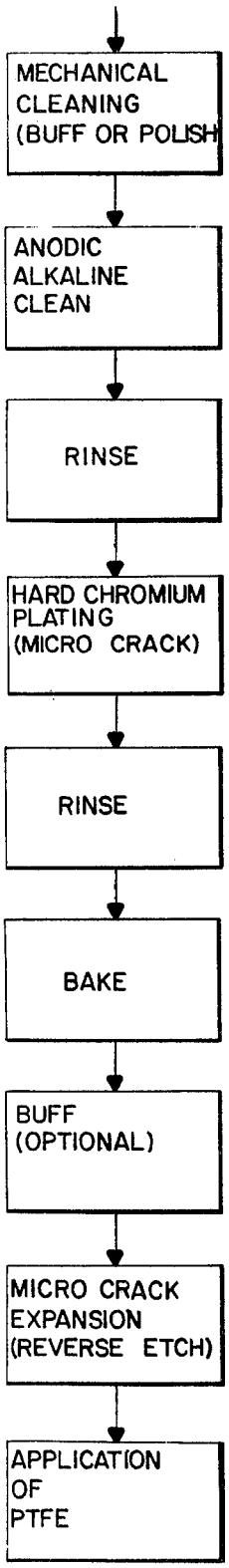
FIG. 1 is a flow diagram illustrating the steps followed in a typical surface treatment operation in accordance with the present invention.

In accordance with the present invention, preferably a base metal of fine grain steel such as AlS18620 alloy steel having a six-to-eight grain size, or a AlS14000 Series alloy steel having a six-to-seven grain size is first mechanically cleaned, for example, by buffing or polishing.

The metal surface then is cleaned by anodic etching for a time period on the order of fifteen to thirty seconds in order to expose the base metal grain structure. Etching may take place in a caustic solution using an alkaline de-ruster stripper metal cleaner; for example, a cleaner sold under the trademark "FERLON" by BASF Wyandotte Corporation of Wyandotte, Mich. If desired, etching may be done by a reverse polarity process in the bath described by placing the metal article in a bath having a temperature of 130° F and at four to six volts. The part is etched for approximately ten seconds following which the polarity of the anode and cathode are reversed to etch for another five seconds, and thereafter rinsing the article in clear water. At this point, the part may be soaked in hot rinse water to warm it as a preliminary to the plating operation.

As a next step the material is hard chromium plated preferably to a thickness on the order of 0.002 to 0.004 inch in a chromic acid bath. Although other plating compositions and procedures may be practiced in accordance with the present invention to provide a microcracked external surface which will accept polytetrafluoroethylene, a hard chromium plating has been found to be most favorable in combination with the polytetrafluoroethylene in providing the desired wear and lubricant properties to the external surface of the article. In order to provide a microcracked hard chromium plating the general procedures followed are in accordance with conventional practice except for the specific sequence of baking and etching steps hereinafter described. Essentially however microcracked chromium, also referred to as dual chromium, is a chromium that is electrodeposited over conventional copper-nickel or all-nickel substrate so that the chromium will contain a multiplicity of fine cracks exposing the underlying nickel. The desired crack pattern may be controlled by the bath temperature, chromic acid concentration, fluoride content and thickness of the plating. While the typical approach is to apply the chromium in multiple layers by application in successive baths, preferably in the present invention the initial crack pattern is formed in a single chromium plating operation employing a chromic acid bath containing a catalyst acid radical, such as, $SO_4$. The $CrO_3/SO_4$ ratio is closely controlled and for example a 100-to-1 ratio by weight of the $CrO_3$ to $SO_4$ at 140° F will result in a medium density crack pattern or plateaus whereas a higher ratio of 125-to-1 at the same temperature would be expected to result in a higher density crack pattern. The cracks generally form a well-defined network of fissures of microscopic size. Although the bath concentration has within limits little effect on the size of the crack pattern, temperature variations have been found to be more critical in determining the relative fineness or coarseness of the microcracks. Thus as the temperature is increased for example from 120° to 140° F the coarseness of the microcracks is substantially increased. Current densities have relatively slight effect as such on the pattern size and typically would range from 1.0 to 4.0 amp per square inch although current density is of decided importance in controlling the plating speed.

A preferred chromium plating solution is Unichrome SRHS chromium plating solution CR-110 produced by M&T Chemicals, Inc. of Rahway, N.J. and which is specifically intended to operate at a chromic acid concentration of 24 to 40 ounces per gallon. It features higher current efficiencies, faster plating speeds, and is less sensitive to momentary current interruption while affording excellent adhesion, increased hardness and lower fatigue resistance loss. Generally, it is recommended for plating directly on steel and where nonplated areas can be fully protected by suitable stop-offs or where incidental etching of unplated areas are of no consequence. Tin-lead alloy anodes are recommended for use with the bath or solution, and the anode cross-section must be sufficient to carry the required current without overheating. Auxiliary or conforming anodes should be lead or lead-sheathed as opposed to bare steel. A six to nine-volt power source is provided for hard chromium operations described in order to fully utilize the maximum current density permissible.

The chromic acid bath is prepared by filling a tank about two-thirds full of clean water and heating to approximately 10° above the intended operating temperature. The chromic acid compound is stirred in while at the same time adding the balance of the water required to bring the solution to a working level and adjusting the bath to the operating temperature. The anodes are placed in the tank and, using dummy cathodes, are electrolyzed at six volts and at the desired operating temperature for a few hours with frequent stirring of the solution. Again in hard plating operations the concentration range is on the order of 24 to 40 ounces per gallon of chromic acid operating between temperature limits of 120 ° and 150° F, the lower temperature favoring better covering power and the higher temperature favoring a higher current density with higher plating speeds and wider usable current density range.

In using the Cr-110 plating solution, the preferred concentration of the bath is chromic acid in the amount of 32 to 36 ounces per gallon together with 0.12 ounces per gallon of sulfate. The temperature is preferably held in a range of 124° F minimum for a fine crack pattern to 137° F for a coarse crack pattern. The current density is one ampere per square inch for a fine crack pattern to two amperes per square inch for a coarse crack pattern. The thickness of the chromium plating is largely determined by time and for a thickness of 0.002 inches would be plated for a time period of 45 minutes and a period of up to 1 to 2 hours for 0.004 inch thickness. In the plating operation, it is important that the area of parts plated at any one time in the bath not exeed one-third the area of the anode so as to prevent overloading of the electrodes during the plating stage. Generally the thickness of the plating may be determined by actual measurement in the course of plating until the desired build-up is achieved.

After the initial plating step, the articles are rinsed in water and placed in an oven to bake at a temperature of 250° to 600° F within a period of one to five hours after plating, the time and temperature being selected to fully oxidize the plated surface as well as to expel the hydrogen so that the chromium plating is protected during the next subsequent reverse etching step.

After banking, the articles are placed in another chromic acid bath corresponding in concentration to that previously described, and a reverse polarity is applied to the bath in order to expand the cracks formed during the initial plating operation. This is of importance in order to permit the polytetrafluoroethylene to become firmly and uniformly embedded in the cracks in the final stage operation. In etching the plated article, the extent of etching is important with respect to control of the depth and width of the cracks or in other words the degree and type of porosity obtained. Anodic etching in a chromic acid solution with or without sulfate is a conventional method of controlling the size or expansion of the cracks and typically is operated at the same temperatures and plating bath as described with respect to the plating operation and at a current density on the order of two to four amps per square inch; however, in the etching step, the specific composition of the chromic acid etching solution and the operating conditions of temperature and current density are not as critical. Both during the plating and etching step suitable racks and fixtures are employed for suspension of the articles to be plated and etched, the most important consideration being the proper masking of plugging by means of stop-offs to prevent build-up of increased deposits around the edges of openings or at the ends of the article being plated. It is stressed once again that the baking step as a preliminary to the reverse etching operation provides for a vastly improved means of controlled microcracking and specifically of selective expansion both in width and depth of the cracks without altering or affecting the plated surface. It should also be noted that the degree of porosity can be controlled to some extent in the final mechanical finishing operation to be described, since the extent to which the etched or porous layer is cut away will determine the degree of porosity which results.

Figure 2:
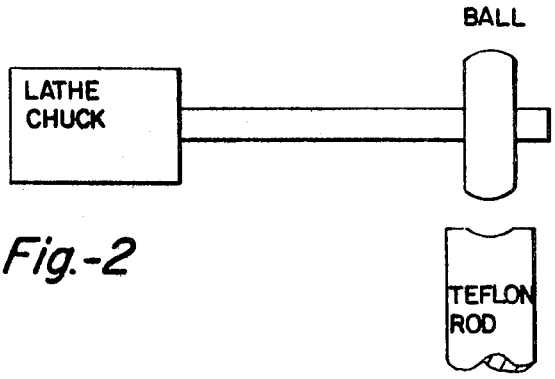
FIG. 2 is a somewhat schematic illustration of the technique of applying a lubricant composition to the plated surface of a metal ball.
Figure 3:
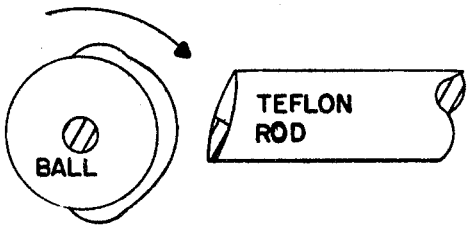
FIG. 3 is another illustration of the manner of applying a lubricant composition to the plated surface of an article at an elevated temperature.

In the next step, each plated article is placed in a chuck lathe as shown in FIG. 2 and rotated at four to eight surface feet per minute. The plated surface is then heated to a temperature above the fusion point of the polytetrafluoroethylene and for example is accomplished by flaming for several minutes with a propane torch. Polytetrafluoroethylene is then applied to the surface for example by forcing a solid rod composed of the polytetrafluoroethylene against the heated surface as shown in FIG. 3. Preferably, in the application of polytetrafluoroethylene to the plated surface, a one-inch rod is employed and the upper half of the rod is cut at an angle just less than vertical in order to provide a funneling effect of any powder applied when the article is rotated. At elevated temperatures on the order of 600° to 900° F the polytetrafluoroethylene will visibly soften or melt on contact with the surface of the article and therefore may be rapidly applied. In addition, by applying slight pressure to the rod the softened or melted polytetrafluoroethylene is more uniformly forced into the cracks. If desired, the rod may also be used in combination with polytetrafluoroethylene powder applied to the heated surface of the rod, since in powder form it will tend to more rapidly melt and fuse with the end of the rod to enter the expanded cracks in the plated surface of the article. Generally, the application of polytetrafluoroethylene may be terminated when it no longer softens on contact with the surface, following which the article is allowed to cool to room temperature. In a final finishing operation, the article may be burnished with a cotton cloth by forcing against the plated surface while the article is rotated at relatively high rates of speed on the order of 150–250 surface feet per minute.

The present invention is further exemplified by the following working examples which are given for the purpose of illustration in connection with hard chromium plating of tube bending mandrel assemblies:

EXAMPLE I

Steel shanks having a diameter of 3.891 inches and a length of ten inches which are employed in tube bending mandrel assemblies were cleaned as described in an alkaline solution for fifteen seconds at a temperature of 130° F at an applied voltage of 4 to 6 volts. The shanks were further cleaned in a chromic acid etch solution for a period of just less than one minute under a reversed polarity. After rinsing, the shanks were plated in a chromic acid bath having a concentration of 32 ounces per gallon at a temperature of 135° F and a current density of 1.25 amperes per square inch. The plating time was two hours and ten minutes in plating the shanks to a thickness of 0.005 inches. After rinsing in water, the articles were baked for approximately 3 hours at a temperature of 350° F. The articles were then etched in a bath having a chromic acid concentration of 28 ounces per gallon at a temperature of 133° F for a period of three minutes and at a current density of two amperes per square inch. Prior to application of polytetrafluoroethylene the shanks were examined and found to have undergone some erosion but also to have a well-defined, uniformly developed, relatively fine crack pattern. The polytetrafluoroethylene was applied to the surface of the shanks after heating the shanks to a temperature of 625° F by applying both in the form of a powder and a solid rod in the manner shown in FIG. 3.

EXAMPLE II

Three steel balls each having a diameter of 3.882 inches were cleaned and etched as described in Example I then were plated in a chromic acid bath having a chromic acid concentration of thirty-three ounces per gallon at a bath temperature of 134° F and a current density of 1.25 amperes per square inch. The balls were plated for a period of 2 hours and 30 minutes resulting in an average plating thickness of 0.0035 inches. After rinsing in water the balls were baked for three hours at a temperature of 350° F and thereafter were etched in a bath having a chromic acid concentration of 28 ounces per gallon at a bath temperature of 125° F for a period of 2 minutes. The balls were lubricated by application of polytetrafluoroethylene in powder form for a period of 5½ minutes at 600° F resulting in a very smooth surface but a slightly excess amount of Teflon on the surface.

EXAMPLE III

A ball prepared according to the cleaning, plating, baking and etching steps according to the previous example was lubricated by application of polytetrafluoroethylene in a tacky condition by heating the surface to a temperature in excess of 600° F for a period of 6 minutes. The lubricant material was found to spread evenly and uniformly completely filling the crack pattern formed. Other balls prepared in a manner previously described were heated over varying time intervals from 45 seconds to periods as great as 12 minutes at temperatures ranging from 600° to 900° F in applying a polytetrafluoroethylene to its surface, the polytetrafluoroethylene being applied both in powder and bar or rod form resulting in a smooth and even surface texture.

The following is an illustration of friction coefficients obtained in the treatment of a mandrel shank employed in bending tools. The shanks were coated as described in Examples II and III and compared to shanks which had been hard chromium plated but received no polytetrafluoroethylene coating. Each set of shanks was subjected to a friction test using a 25 lb. static weight suspended from a steel band 2 inches wide affixed at its opposite end to a 50 lb. scale, the band being trained over each type of shank as it was rotated at a speed of 85 surface feet per minute. The friction coefficient was measured by determining the resistance to rotation of each type of shank as reflected by the degree of deflection of the scale.

DRY FRICTION COMPARISON TEST

| A - Hard Chrome Plated Shanks Without Polytetrafluoroethylene Coating | |
|---|---|
| Scale (In Pounds) | Lapsed Time in Minutes |
| 34 | 0 |
| 36 | 3 |
| 42 | 5 |
| 44 | 6 |
| 50 (Maximum on sale) | 6½ |
| **B - Hard Chromium Plated Shanks With Polytetrafluoroethylene Coating** | |
| Scale (In Pounds) | Lapsed Time in Minutes |
| 36 | 0 |
| 36 | 3 |
| 36 | 5 |
| 36 | 6 |
| 36 | 10 |
| 34 | 20 |
| 36 | 29 |
| 40 | 39 |
| 44 | 60 |
| 48 | 69 |
| 50 | 70 |

Based on the comparative testing employing a 25 lb. load cell, the shanks prepared according to the present invention exhibited vastly improved lubricant and wear characteristics over an extended time period during which they were subjected to the resistance imposed by the steel band and suspended 25 lb. load.

It will therefore be understood by those skilled in the art that metal surfaces prepared in accordance with the foregoing disclosure would have many useful applications other than the specific applications described with respect to tube bending mandrel assemblies. Thus, while the present preferred embodiments of the invention and methods of practicing same have been illustrated and described, it will be recognized that the invention may be otherwise embodied and practiced within the scope of the fllowing claims.

What is claimed is:

1. The method of plating a metal surface comprising the steps of:

(a) cleaning the metal surface;

(b) electroplating the surface with chromium in a chromic acid bath to form a microcracked chromium plated surface portion;

(c) heating the plated surface to oxidize the external surface thereof;

(d) etching the plated surface to expand the cracks formed in the plating step; and (e) followed by applying a perfluorocarbon composition under pressure to fill the microcracks.

2. The method according to claim 1 in which the plated surface is baked during step (c) to a temperature on the order of 250° to 600° F within a period of one to five hours after plating.

3. The method according to claim 1 in which step (d) is further characterized by reverse etching of the plated surface to expand the microcracks formed in the plating step.

4. The method of surface treating a metal part comprising the steps of:

(a) plating the surface by electrodeposition in a chromic acid solution to form a microcracked chromium plated surface;
(b) baking the plated surface at a temperature in the range of 300°–400° F for a period of approximately three hours;
(c) etching the plated surface to expand the microcracks; and
(d) applying a polytetrafluoroethylene to the surface at an elevated temperature to fill the cracks formed in the plated surface.

5. The method according to claim 4 in which said polytetrafluoroethylene is applied to the plated surface at an elevated temperature in excess of 600° F.

6. The method according to claim 4 in which the polytetrafluoroethylene is contained in a solid rod which is applied against the plated surface which has been heated to a temperature in the range of 600° to 900° F.

7. The method of treating a metal surface which comprises the steps of:
(a) cleaning the surface;
(b) plating the surface with chromium by electrodeposition to form a microcrack chromium plated surface;
(c) baking the plated surface to oxidize same;
(d) expanding the microcrack pattern by etching followed by heating the plated surface to a point approximating the fusion point of a perfluorocarbon composition; and
(e) thereafter applying the perfluorocarbon composition to the surface to force the perfluorocabon composition into the microcracks.

8. The method according to claim 7 in which the perfluorocarbon is applied after flame heating the surface to a temperature above the fusion point of the perfluorocarbon.

9. The method according to claim 7 in which the microcracks are expanded by reverse etching in a chromic acid bath.

10. The method according to claim 7 in which the polyfluorocarbon composition is in the form of a solid rod brought into engagement with the plated surface as one of the plated surfaces and the solid rod is rotated with respect to the other.

11. The method of forming a lubricant surface on a tube bending mandrel assembly which is comprised of a plurality of interconnected metal balls and a shank portion at one end comprising the steps of:
(a) cleaning the external surfaces of the metal balls and shank;
(b) electroplating the external surfaces in a chromic acid bath for a time period and at a temperature level sufficient to form a hard chromium plated surface containing microcracks therein;
(c) heating the metal balls and shank at a temperature and for a time period sufficient to oxidize the plated surface thereof;
(d) reverse etching the metal balls and shank to expand the cracks formed in the plating surface; and
(e) applying a polytetrafluoroethylene to the external plated surfaces of the metal balls and shank at an elevated temperature sufficient to cause the polytetrafluoroethylene to fuse into and to fill the microcracks formed in the plated surface portions.

* * * * *